United States Patent [19]

Oishi

[11] 3,977,877

[45] Aug. 31, 1976

[54] FILM UNIT COMPRISING AN IMAGE RECEIVING ELEMENT AND LIGHT INTERCEPTING ELEMENT ATTACHED TOGETHER ALONG AT LEAST ONE EDGE THEREOF

[75] Inventor: Yasushi Oishi, Minami-ashigara, Minami-Ashigara, Japan

[73] Assignee: Fuji Photo Film Co., Ltd., Minami-ashigara, Japan

[22] Filed: Aug. 19, 1974

[21] Appl. No.: 498,336

[30] Foreign Application Priority Data

Aug. 17, 1973 Japan ..... 48-92115

[52] U.S. Cl. ..... 96/76 C; 354/304

[51] Int. Cl.[2] ..... G03C 1/48; G03D 9/02

[58] Field of Search ..... 96/76 C; 354/304

[56] References Cited

UNITED STATES PATENTS

| | | | |
|---|---|---|---|
| 3,586,501 | 6/1971 | Norquist et al. | 96/76 C |
| 3,613,537 | 10/1971 | Frost | 96/76 C |
| 3,647,437 | 3/1972 | Land | 96/3 |

*Primary Examiner*—David Klein
*Assistant Examiner*—Richard L. Schilling
*Attorney, Agent, or Firm*—Sughrue, Rothwell, Mion, Zinn and Macpeak

[57] ABSTRACT

A silver salt diffusion transfer photographic film unit suitable for exposing a photosensitive element in a camera and processing the exposed photosensitive element in a bright place outside the camera. The film unit includes a photosensitive element having a silver halide emulsion layer, an image-receiving element having an image-receiving layer containing silver precipitating nuclei, a light-shielding element to protect the silver halide emulsion layer from ambient light during the development of the film unit in a bright place outside the camera, a container retaining an alkaline processing solution which is rupturable by means of a pressure applying member and positioned to allow the processing solution to spread into a clearance between the emulsion layer of the photosensitive element and the image-receiving layer of the image-receiving element in the form of a layer, a light-reflecting material in an amount sufficient to form a white background for a transferred silver image which is positioned between the image-receiving layer and the emulsion layer or is introduced between the image-receiving layer and the emulsion layer when the processing solution is spread, and a silver halide developer. The image-receiving element and the light-shielding element are juxtaposed in such a manner that the image-receiving layer is faced inward and are fixed at at least one edge thereof to form a composite structure having an opening through which the photosensitive element is introduced between the image-receiving element and the light-shielding element in such a manner that the emulsion layer faces the image-receiving layer. The photosensitive element is imagewise exposed in the camera, introduced through the opening into the composite structure, and passed through a pressure applying member for rupturing the alkaline processing solution container.

28 Claims, 11 Drawing Figures

FIG. 1
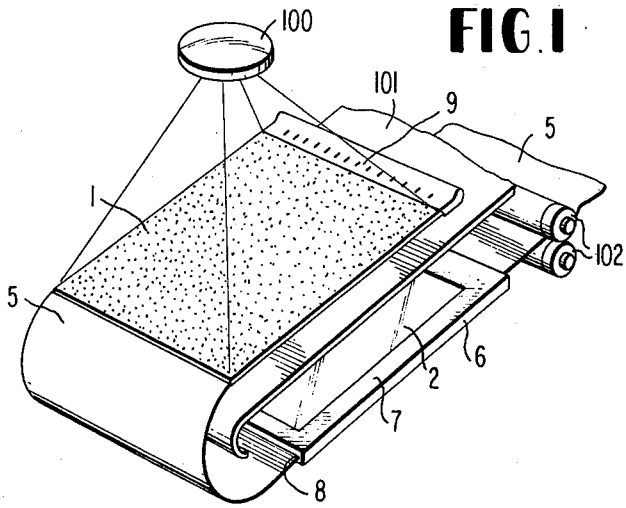
FIG. 2
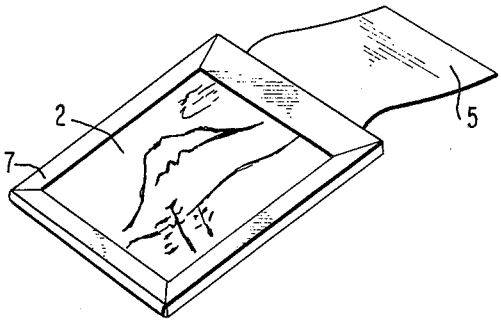
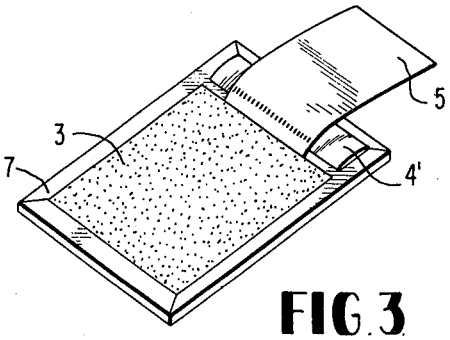
FIG. 3
FIG. 4
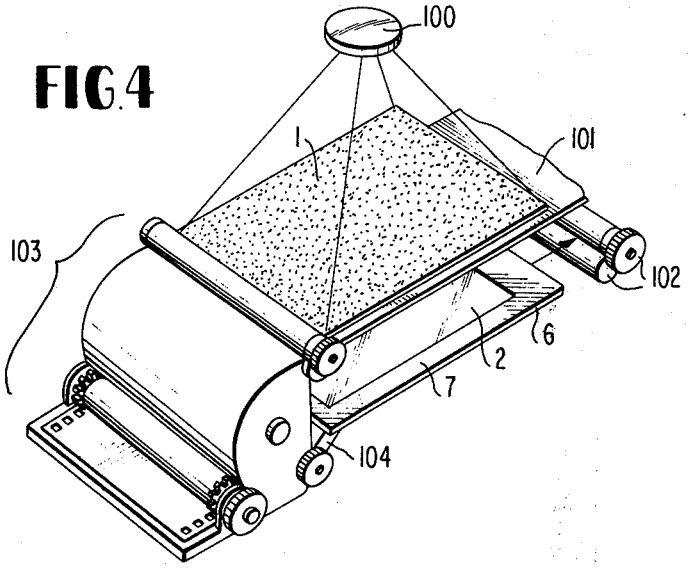
FIG. 5
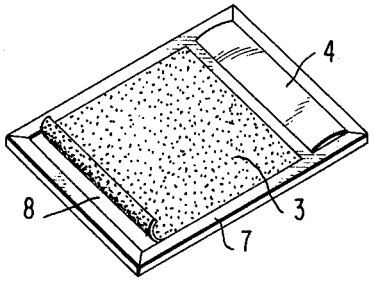
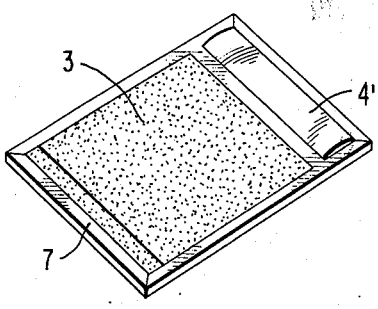
FIG. 7
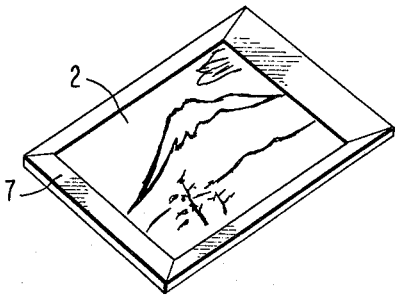
FIG. 6

FIG. 8
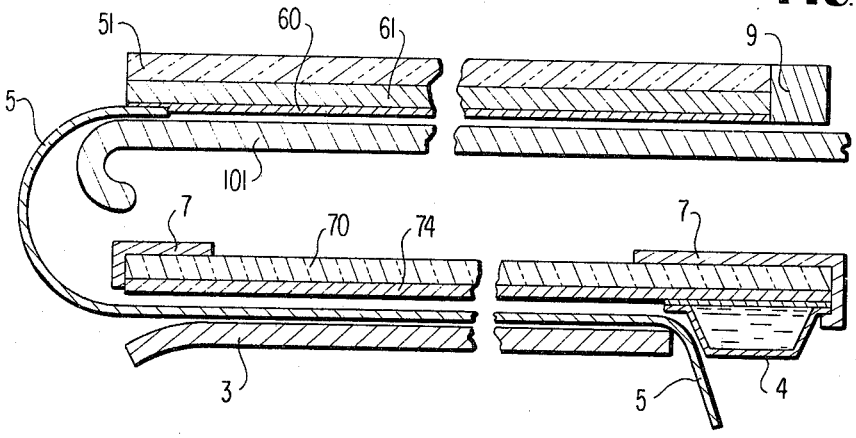
FIG. 9
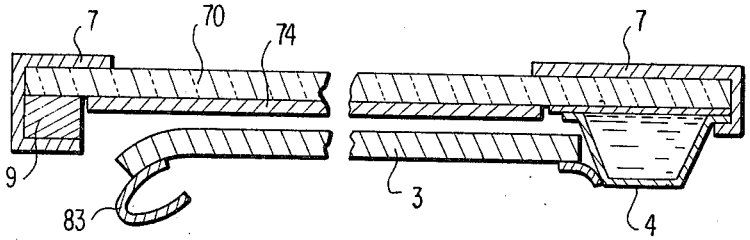
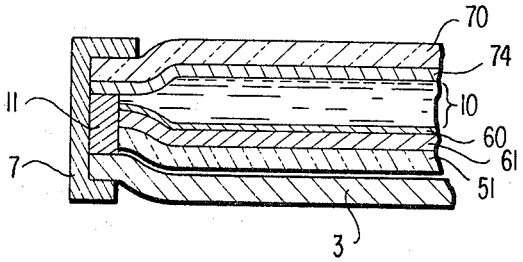
FIG. 10
FIG. 11
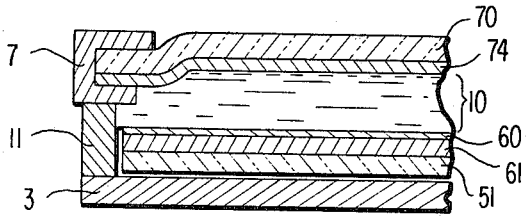

FILM UNIT COMPRISING AN IMAGE RECEIVING ELEMENT AND LIGHT INTERCEPTING ELEMENT ATTACHED TOGETHER ALONG AT LEAST ONE EDGE THEREOF

BACKGROUND OF THE INVENTION

1. Field of the Invention

The present invention relates to a material for use in diffusion transfer photography. More particularly, the present invention relates to a silver salt diffusion transfer photographic film unit wherein a light-sensitive element is exposed in a camera and developed, and which functions to provide the appearance of the image in a bright place outside the camera.

2. Description of the Prior Art

The so-called silver salt diffusion transfer photography wherein exposed silver halide grains are developed and then the remaining unexposed silver halide grains are dissolved in the form of a silver complex salt and diffused into a separate image-receiving layer, whereby a transferred positive image of the silver is obtained by the action of silver precipiting nuclei present in the image-receiving layer, has features that a high sensitivity is obtained and a positive image is directly obtained at a place separated from the negatively developed silver in a single developing processing. This process is widely used in materials for office copy and highly sensitive materials for photography.

A film unit wherein a photosensitive element is exposed in a camera, brought in contact with a processing composition, withdrawn from the camera while maintaining the photosensitive element in a light-shielded condition, and developed in a bright place, and furthermore the production of the transferred silver image can be successively observed in a bright place and stored without separating the image-receiving layer, is useful. For instance, in the field of color transfer photography, with the film units as described in U.S. Pat. Nos. 3,415,644, 3,573,043, and 3,613,421, an image is produced on the side to which an imagewise exposure is applied. In this case, an optical system for the reversal of the image must be incorporated into the camera for the purpose of preventing the production of an image wherein left and right are reversed. Thus, the construction of the camera is specific and complicated, and special attention should be paid for maintenance of the accuracy of focus.

A film unit wherein a transferred image is produced on a side opposite that to which the exposure is applied is advantageous in that it can be used in commonly used cameras. In this type of film unit, however, both sides of the photosensitive element should be shielded against light during the processing. The side opposite that to which the exposure is applied can be shielded by coating a layer which is permeable to a processing solution containing a hygroscopic material such as carbon, whereas the side to be imagewise exposed should be provided with a means for completely shielding the element from strong light during the processing in a bright place although it contains no material which scatters and absorbs light during the processing. As the light-shielding means for the surface to be exposed during the processing, a light-shielding element which is hinged at one end of the film unit, as described in U.S. Pat. Nos. 3,415,645 and 3,415,646, is known. This element is removed from the surface to be exposed during the imagewise exposure and it covers an exposed area when the processing solution is spread. In removing, however, the light-shielding element in such manner in the camera, many problems arise in that a large space is required in the camera, the mechanism of the camera is complicated, and the construction of a cassette for accommodating the film unit is complicated, etc. Another light-shielding means used during the processing of the exposed area of the film unit, as described in U.S. Pat. No. 3,635,707, involves spreading a hygroscopic material containing the processing solution on the exposed area of the photosensitive element. This method, however, can be applied to a film wherein an image-receiving layer and a photosensitive layer are superposed on a support while it cannot be applied to the layer construction of the present invention wherein the image-receiving element and the photosensitive element are coated on different transparent supports.

SUMMARY OF THE INVENTION

An object of the present invention is to provide a film unit which can be exposed using a common camera which is not equipped with an optical system for the reversal of the image and after the exposure is withdrawn from the camera into a bright place, providing a positive image in which the left and right of the image correspond to the original.

Another object of the present invention is to provide a film unit which, even though processed in a bright place, can provide a transferred silver image wherein a large difference in absorbance (difference between the maximum density and the minimum density) is maintained.

Still another object of the present invention is to provide a film unit which can be exposed in a camera and processed in a bright place outside the camera, and which does not need a separation of an image-receiving element from a photosensitive element after the processing or the timing of the stopping of development.

A further object of the present invention is to provide a diffusion transfer image-receiving element which is equipped with means for shielding ambient light from the backside of the photosensitive element during the processing and during contact with the photosensitive element.

An even further object of the present invention is to provide a film unit which allows a photosensitive element to be exposed in a camera under good planar conditions.

A still further object of the present invention is to provide a film unit which is accommodated in a camera together with a plurality of film units and which can be withdrawn one by one from the camera through a pressure applying member by a simple procedure.

These and other objects of the present invention will become apparent from the following detailed explanation and examples.

It has been found that the above-described objects of the present invention can be attained with the following film unit. That is, the film unit of the present invention is a silver salt diffusion transfer photographic film unit which comprises:

1. a photosensitive element comprising a support and a silver halide emulsion layer on the support, 2. an image-receiving element comprising a transparent support and an image-receiving layer on the transparent support in which the image-receiving layer contains silver precipitating nuclei and receives a transferred image from the photosensitive element, 3. a light-shielding element which has substantially the same area as the image-receiving element and which protects the silver halide emulsion layer of the photosensitive element from ambient light during development of the film unit in a bright place, 4. a rupturable container retaining an alkaline processing solution and positioned to allow the alkaline processing solution to spread into a clearance between the emulsion layer and the image-receiving layer of the image-receiving element in the form of a layer, 5. a light-reflecting material in an amout sufficient to form a white background of a transferred silver image which is positioned between the image-receiving layer of the image-receiving element and the emulsion layer of the photosensitive element or is introduced between the image-receiving layer of the image-receiving element and the emulsion layer of the photosensitive element when the alkaline processing solution is spread, and 6. a silver halide developer for the silver halide emulsion layer of the photosensitive element;

wherein the image-receiving element and the light-shielding element are juxtaposed in such a manner that the image-receiving layer of the image-receiving element faces inside, and are fixed at at least one edge thereof to form a composite structure having an opening through which the photosensitive element can be introduced between the image-receiving element and the light-shielding element in such a manner that the emulsion layer of the photosensitive element faces the image-receiving layer of the image-receiving element.

Using the film unit of the invention the photosensitive element is suitably imagewise exposed in a camera, introduced through the opening into the composite structure, and passed through a pressure applying member for rupturing the container retaining the alkaline processing solution.

BRIEF DESCRIPTION OF THE DRAWINGS

FIG. 1 is a perspective view showing an arrangement of one film unit of the present invention in a camera.

FIG. 2 is a perspective view of the surface of the processed film unit of the present invention.

FIG. 3 is a perspective view of the back of the processed film unit of the present invention.

FIG. 4 is a perspective view showing another arrangement of the film unit of the present invention in a camera.

FIG. 5 is a perspective view of the back of the composite structure of the present invention.

FIG. 6 is a perspective view of the image side of the processed film unit of the present invention.

FIG. 7 is a perspective view of the back of the processed film unit of the present invention.

FIG. 8 is a sectional view of the film unit as shown in FIG. 1.

FIG. 9 is a sectional view of the composite structure as shown in FIG. 5.

FIGS. 10 and 11 are partial sectional views of the processed film unit of the present invention.

DETAILED DESCRIPTION OF THE INVENTION

In the film unit of the present invention, the photosensitive element is imagewise exposed through the transparent support in the camera and then introduced through the opening into the composite structure comprising the image-receiving element and the light-shielding element. At this time, the photosensitive element is introduced in such a manner that the support is in contact with the light-shielding element and the emulsion layer faces the image-receiving element. After introduction into the composite structure, the photosensitive element is required to be substantially completely shielded against ambient light from the side of the support. The construction of the film unit of the present invention in the state that the photosensitive element is introduced into the composite structure is similar to that of an envelope containing a card. In this way, the film unit in which the photosensitive element, the image-receiving element, and the light-shielding element are united, is passed between the pressure applying member. By this procedure, the alkaline processing solution retaining container is ruptured and the alkaline processing solution is spread between the photosensitive element and the image-receiving element, and thus the development of the emulsion layer and the formation of a transferred image begin. Then, in many cases, the film unit is withdrawn from the camera to a bright place. In this case, between the image-receiving layer and the emulsion layer, a light-reflecting material in an amount sufficient to form a white background of the transferred image is placed in the form of a layer. With the light-reflecting material-containing layer for the background, the formation of the transferred image is observed as the processing proceeds. During the processing, the emulsion layer is protected by the light-shielding element against ambient light from the side of the support while ambient light from the side of the image-receiving element is weakened by being reflected and scattered by the light-reflecting material-containing layer.

In the film unit of the present invention, it is preferred that in addition to the above-described essential components, a light-absorbing material be provided between the image-receiving layer and the emulsion layer for the purpose of completely protecting the emulsion layer from ambient light from the side of the image-receiving element. One preferred method of providing the light-absorbing a dye material is to add to the light-reflecting material-containing processing solution which becomes colorless when the processing is completed. Dyes which can be used in this method are described in U.S. Pat. No. 3,647,437. Another preferred method of providing the light-absorbing material is, as described in U.S. patent application Ser. No. 470,488, filed May 16, 1974, to cover the surface of the emulsion layer which is not in contact with the support, with a light-shielding layer which contains the light-absorbing material and is permeable to the processing solution. In this case, the light-reflecting material is spread over the light-shielding layer together with the processing solution and it is preferred that the light-reflecting material be previously incorporated into the processing solution-permeable layer lying on the surface of the image-receiving layer which is not in contact with the support.

In addition to the above-described essential components, the film unit of the present invention preferably has a transparent neutralizing layer which contains an acid in an amount sufficient to reduce the pH of the color image to a stable pH by neutralizing the alkali in the processing solution after the formation of the transferred image is substantially completed. This neutralizing layer is preferably provided between the transparent support of the photosensitive element and the emulsion layer, or between the transparent support of the image-receiving element and the image-receiving layer, or at both of these positions.

The composite structure comprising the image-receiving element and the light-shielding element of the present invention is fixed at at least one edge in such a manner that the image-receiving layer is feced toward the inside of the composite formed and has an opening along another edge through which the exposed photosensitive element is introduced into the composite structure. Thus, it is preferred that the two elements are fixed, leaving a space equivalent to the thickness of the photosensitive element so that the photosensitive element can be smoothly introduced between the two elements. It is, therefore, preferred that a member for keeping the space is inserted between the two elements along the edge thereof. Moreover, it is preferred that the surfaces of the elements in contact with each other be treated so as to reduce the friction between them. Furthermore, it is preferred that the surfaces of the elements in contact with each other are subjected to an antistatic treatment so as to prevent the unwanted deterioration of the silver halide emulsion due to static electricity caused by friction which is produced when the photosensitive element is introduced into the composite structure. Particularly, it has been found that the application of the antistatic treatment onto the surface of the support for the photosensitive element and the inside surface of the light-shielding element, and the addition of an ultraviolet light absorber into a back layer of the photosensitive element or the transparent support thereof are effective in preventing static marks.

The fixing of the image-receiving element and the light-shielding element along the edge thereof can be accomplished by various methods. Preferred methods include a direct joining using an adhesive containing a volatile solvent, an adhesive composed ot a thermoplastic polymer which is suitable for heat sealing, and a thermosetting polymer adhesive as well as a pressure sensitive tape having the above-described adhesive layer. A method wherein the edge of the composite structure is covered with a light-shielding pressure sensitive tape is particularly useful since the photosensitive element introduced into the composite structure is protected against ambient light, simultaneously.

The composite structure has an opening for introducing the photosensitive element along the front edge, the side edge, or the back edge thereof. The front edge, side edge, or back edge is determined with respect to the direction that the film unit approaches the pressure applying member.

In the process of forming the transferred image by the use of the film unit of the present invention, the exposed photosensitive element is introduced into the composite structure by an appropriate procedure. One procedure is to use an introducing member such as a leader film or a leader paper. In this procedure, the introducing member connected to one edge of the photosensitive element is passed through a first opening for the photosensitive element provided on the composite structure, between the image-receiving element and the light-shielding element, and through a second opening provided along the edge opposite to the first opening, and thus it passes through the composite structure. The photosensitive element is introduced into the composite structure by pulling the introducing member after the exposure while the composite structure is maintained still. In this case, the film unit is preferably provided with a means which enables the photosensitive element to be fixed at a predetermined position, such as a stopper. In accordance with another useful procedure, the photosensitive element is conveyed by a movable apparatus of a camera or a film cassette and pushed into the composite structure through a slit positioned in the vicinity of the opening of the composite structure. In this case, the photosensitive element sometimes has no direct connection with the composite structure of the image-receiving element and the light-shielding element before the exposure. However, since they are used as a unit, they are considered to be one unit, i.e. a film unit.

The light-shielding capability required for the light-shielding element as used in the present invention varies depending upon the purpose of the film unit and the photosensitivity of the silver halide emulsion, etc. In general, it is preferred that the optical density is not less than about 5, preferably not less than 7 in the ultra-violet, visible, and near infrared regions, particularly over the wavelength region of about 300 to 750 microns. As the light-shielding element, a dimensionally stable layer containing a light-absorbing material such as carbon black, particularly the layer as described in U.S. Pat. No. 3,607,818 and Japanese Patent Publication No. 24547/1968, a carbon black-containing paper, a polymer sheet on which a carbon black-containing polymer layer is coated, etc., can be advantageously used. Furthermore, the dimensionally stable light-shielding layer element can be produced by the use of a metal foil such as aluminum and tin, a laminate film of a metal and a polymer, or a film or laminate produced by vapor-depositing a metal such as aluminum on a polymer such as polyethylene terephthalate. It is preferred from the standpoint of good appearance that the outer layer of the light-shielding element is coated with a layer containing a light-reflecting material such as titanium dioxide.

In the film unit of the present invention, the processing solution-retaining container is preferably placed at the front part of the composite and positioned so that the processing solution can be liberated between the image-receiving layer and the emulsion layer of the photosensitive element introduced into the composite structure. The projection of the processing solution-retaining container is preferably placed on the back of the film unit, i.e., the light-shielding element, from the standpoint of good appearance of the processed print. The processing solution container is incorporated into the film unit by previously fixing the container to the front part of the composite structure or fixing the container to one end of the photosensitive element in such a manner that the container comes to the front part of the film unit when the photosensitive element is introduced.

It is preferred that the film unit be provided with a means to form a predetermined clearance between the image-receiving element and the photosensitive element so that the processing solution can be spread between the two elements in the form of a layer having a predetermined thickness. For this purpose, the film unit is preferably equipped with a spacer, i.e., a member for providing a clearance, along both edges of the film unit. The spacer can be placed either between the two elements or along the edge of the outer side of the image-receiving element. When the spacer is present on the outer side, the area of the image-receiving element where the processing solution is spread is extended outward by the thickness of the spacer. It is preferred that the spacer placed along the edge of the outer side be simultaneously used as a frame of a print. A spacer on the outer side of the light-shielding element also separates the light-shielding element and the photosensitive element, providing the clearance for spreading the processing solution. Moreover, a member to maintain the clearance for introducing the photosensitive element into the composite structure serves as the spacer.

This spacer is selected so as to allow the processing solution to be spread in the form of a layer having a thickness of about 20 to 400 microns, preferably 50 to 250 microns.

To surely spread the processing solution over the entire surface formed between the photosensitive element and the image-receiving element, it is preferred that the container retains the processing solution in an excess of the necessary quantity which is calculated from the predetermined layer thickness and the predetermined area where the processing solution is spread, and particularly in a quantity of from about 1.05 to 2.5 times the necessary quantity which depends on the area of the spread solution and the thickness of the spread solution. It is preferred that the end part of the film unit is equipped with a means which receives the excess processing solution and prevents the alkaline processing solution from leaking out of the film unit and to injure or stain the user. For this purpose, a honeycombed plate member, or a spongy or fibrous porous member which can receive the excessive processing solution, is useful. The reservoir as described in U.S. Pat. Nos. 3,615,460 and 3,761,269, which performs the function of neutralizing the excessive processing solution, is particularly useful.

In the film unit of the present invention, the photosensitive element is outside of the composite structure comprising the image-receiving element and the light-shielding element until the exposure is completed. Under this condition, the photosensitive element and the composite structure can be positioned in a camera with various relative relationships. To make the camera compact and so that a plurality of the film units can be placed therein, the composite structures are preferably juxtaposed. In this case, the photosensitive element and the composite structure are placed with the transparent support and the image-receiving element toward the lens of the camera, respectively. In this arrangement, the exposed photosensitive element is conveyed in a U-form by the above-described introducing method and introduced through the opening into the composite structure.

In the case where a number of film units are placed in the camera and the photosensitive elements are exposed while superposed on each other, it is preferred that the surface of the opposite side of the photosensitive element be coated with a light-absorbing material-containing layer and particularly the processing solution-permeable light-shielding light-absorbing material-containing layer containing, e.g., carbon black, as described in U.S. patent application Ser. No. 470,488, filed May 16, 1974.

Silver halide emulsions which can be used in the present invention are colloidal dispersions of silver chloride, silver bromide, silver chlorobromide, silver iodobromide, silver chloroiodobromide or mixtures thereof. The halogen composition is selected depending upon the use of the photosensitive element and the processing conditions. A silver iodobromide or silver chloroiodobromide emulsion wherein the iodide content is about 1 to 10 mole %, the chloride content is not more than about 30 mole % and the remainder is bromide, is most preferred. An average grain size of about 0.1 to 2 microns is useful and depending upon the purpose of the photosensitive element, a uniform grain size is desired. The grains may be of the cubic crystal system, the octahedral crystal system, or a mixed crystal system. These silver halide emulsions can be produced by conventional methods as described in P. Glafkides, *Chimie Photographique*, 2nd. Edition, Chapters 18 to 23, Paul Montel, Paris (1957). That is, a soluble silver salt such as silver nitrate and a water-soluble halide such as potassium bromide are reacted in a solution of a protective colloid such as gelatin and crystal growth is carried out in the presence of excess halide or a solvent for silver halide such as ammonia. Precipitating processes such as a single or double jet process, a pAg control double jet process, etc., can be employed. Separation of the soluble salts from the resulting emulsion can be accomplished by washing of the coagulated emulsion, dialysis, or precipitation by addition of a precipitation agent such as an anionic polymer having a sulfone group, a sulfuric acid ester group, or a carboxyl group or an anionic surface agent and pH adjustment, or by the use of acylated protein such as phthaloyl gelatin as a protective colloid and pH adjustment.

The silver halide emulsion as used in the present invention is preferably chemical-sensitized by heating together with the natural sensitizers contained in gelatin, a sulfur sensitizer such as sodium thiosulfate or N,N,N'-triethyl thiourea, a gold sensitizer such as a monovalent thiocyanate complex salt or a thiosulfate complex salt, or a reduction sensitizer such as stannous chloride or hexamethylenetetraamine. In the present invention, an emulsion which tends to easily form a latent image on the surface of the silver halide grains, and the emulsion, as described in U.S. Pat. Nos. 2,592,550 and 3,206,313, which tends to easily form a latent image inside the silver halide grains can be used.

The silver halide emulsion as used in the present invention can be stabilized by the use of additives such as 4-hydroxy-6-methyl-1,3,3*a*,7-tetrazaindene, 5-nitroimidazole, 1-phenyl-5-mercaptotetrazole, 8-chloromercuriquinoline, benzenesulfinic acid, and pyrocatechin. In addition, inorganic compounds such as cadmium salts, mercury salts and complex salts of the metals of the platinum group, e.g., the chlorocomplex salt of palladium, are useful for the stabilization of the photosensitive element of the present invention. Moreover, the silver halide emulsion can contain a sensitizer, such as polyethylene oxide.

The silver halide emulsion as used in the present invention, can have, if desired, a color sensitivity extended by the use of optical sensitizing dyes. Useful sensitizing dyes include the cyanines, merocyanines, holopolar cyanines, styryls, hemicyanines, oxanols, hemioxanols, and the like. Representative examples of optical sensitizers are described in P. Glafkides, supra, Chapters 35 to 41 and M. Hamer, *The Cyanine Dyes and Related Compounds*, Interscience. In the practice of the present invention, cyanines wherein a nitrogen atom of the nucleus is substituted with an aliphatic group having a hydroxy group, a carboxyl group, or a sulfo group, such as those cyanines as described in U.S.

Pat. Nos. 2,503,776, 3,459,553, and 3,177,210 are particularly useful.

The processing solution permeable layers, i.e., a silver halide emulsion layer and auxiliary layers such as a protective layer, an intermediate layer, etc. contain a hydrophilic polymer as a binder. Suitable hydrophilic polymers include gelatin, casein, gelatin modified with an acylating agent and the like, vinyl polymer grafted gelatin, proteins such as albumin, cellulose derivatives such as hydroxyethyl cellulose, methyl cellulose, and the like, polyvinyl alcohol or partially hydrolyzed polyvinyl acetate, polymeric non-electrolytes such as polyvinyl pyrrolidone and polyacrylic amide, polyacrylic acid, partially hydrolyzed polyacrylamide, anionic synthetic polymers such as a copolymer of vinyl methyl ether and maleic acid and ampholitic synthetic polymers such as copolymers of N-vinylimidazole, acrylic acid and acrylamide, or polyacrylamide subjected to the Hofmann reaction, etc. These hydrophilic polymers can be used alone or in admixture with each other. These hydrophilic layers can contain latex-like polymer dispersions of hydrophobic monomers such as alkyl acrylates, alkyl methacrylates, and the like. The above described hydrophilic polymers, particularly polymers having functional groups such as an amino group, a hydroxyl group and a carboxyl group can be rendered insoluble by the use of various cross-linking agents without losing its processing solution permeability. Particularly useful cross-linking agents include aldehyde compounds such as formaldehyde, glyoxal, glutaraldehyde, mucochloric acid, and acrolein oligomer; aziridine compounds such as triethylene phosphoramide as described in Japanese Patent Publication No. 8790/1962; epoxy compounds such as 1,4-bis(2′,3′-epoxypropoxy) diethyl ether as described in Japanese Patent Publication No. 7133/1959; active halogen compounds such as 2-hydroxy-4,6-dichloro-S-triazine sodium salt as described in U.S. Pat. No. 3,325,287; active olefin compounds such as hexahydro-1,3,5-triacryl-S-triazine; methylol compounds such as N-polymethylol urea and hexamethylol melamine; and polymeric compounds such as dialdehyde starch and 3-hydroxy-5-chloro-S-triazinylated gelatin as described in U.S. Pat. No. 3,362,827. Moreover, these hydrophilic polymer layers can contain cross-linking accelerators such as a carbonate and resorcin as well as the cross-linking agents.

The photographic layer as used in the present invention can be coated using various coating methods such as a dipping method, a roller method, an air knife method, a bead coating method as described in U.S. Pat. No. 2,681,294 and a curtain method as described in U.S. Pat. Nos. 3,508,947 and 3,513,017, etc. In case of a photosensitive element of a multi-layer construction, it is preferred to coat a plurality of layers at the same time by the use of a multi-slit hopper as described in U.S. Pat. Nos. 2,761,417, 2,761,418, 2,761,419, and 2,761,791.

To facilitate the coating of the photographic layer as used in the present invention, the coating composition preferably contains various surface active agents as auxiliary coating aids. Useful auxiliary coating aids include non-ionic surface active agents such as saponin, ethylene oxide adducts of p-nonylphenyl, alkylethers of sucrose, monoalkyl ethers of glycerin and the like; anionic surface active agents such as sodium dodecylsulfate, sodium p-dodecylbenzene sulfonate, sodium dioctylsulfosuccinate, and the like; and amphoteric surface active agents such as carboxymethyldimethyllauryl ammonium hydroxide inner salt, "Deriphat 151", trade name, produced by General Mills, betaine based compounds as described in U.S. Pat. No. 3,441,413 and British Patent No. 1,159,825, and the like.

To facilitate the coating of the photographic layer used in the present invention, the coating composition can contain various viscosity increasing agents. For instance, anionic polymers such as cellulose sulfate, poly-p-sulfostyrene potassium salt, and acrylic acid based polymers as described in U.S. Pat. No. 3,655,407, which exhibit a viscosity increasing action due to their interaction with the polymer binder contained in the coating composition, as well as high molecular weight polyacrylamide, which increases the viscosity of the coating composition due to its viscosity, are useful.

The processing composition as used in the present invention is a liquid composition containing the processing components required for developing the silver halide emulsion and dissolving the silver halide. The solvent mainly is water and, sometimes, contains hydrophilic solvents such as methanol and methylcellosolve. The processing composition is maintained at the pH necessary to develop the emulsion layer and contains an alkali sufficient to neutralize the acid produced during the development. Suitable alkalis include sodium hydroxide, potassium hydroxide, a dispersion of calcium hydroxide, tetramethylammonium hydroxide, sodium carbonate, sodium triphosphate, diethylamine, and the like. The pH of the alkali is preferably not less than about 12 at room temperature (about 20°–30°C). More preferably, the processing composition contains hydrophic polymers such as high molecular weight polyvinyl alcohol, hydroxyethyl cellulose, sodium carboxymethyl cellulose, and the like. These polymers not only provide the processing composition with a viscosity of not less than 1 poise, preferably on the order of about 1000 poises at room temperature so that the composition can be spread uniformly at processing, but also form a non-fluid film when the processing composition is concentrated through the migration of the aqueous solvent into the photosensitive element and the image-receiving element during the processing and facilitates uniting the film unit after the processing. This polymer film acts to control the migration of an additionally dissolved silver to the image-receiving layer after the formation of the image is substantially completed and to prevent change in the image.

In some cases, it is preferred that the processing composition contain a light-absorbing material such as carbon black to prevent fogging of the silver halide emulsion due to ambient light during the processing as well as the desensitizers as described in U.S. Pat. No. 3,579,333.

The image-receiving layer as used in the present invention contains silver precipitating nuclei. The silver precipitating nuelei accelerate the reduction of the silver salt and are also called physical developing nuclei. Materials constituting the silver precipitating nuclei are water-insoluble sulfides, selenides, tellurides, and the like of zinc, mercury, lead, cadmium, iron, chromium, nickel, tin, cobalt, copper, silver, gold and the like; heavy metals such as silver, gold, platinum, palladium, and the like; and anti-diffusion polymer compounds which render the silver ion immobile through combination therewith, such as polyvinyl mercaptoactate, as well as those compounds, which are conventionally well-known as the physical developing nuclei, as described in U.S. Pat. Nos. 2,352,014, 2,740,717, and 3,620,155. These physical developing nuclei are preferably in the form of fine colloidal particles. A suitable average size of the physical developing nuclei ranges from about 10 to 2500 angstroms. Fine colloidal particles of these water-insoluble inorganic compounds can be produced by methods well-known in the field of colloid chemistry. For instance, metal colloids can be produced by reducing the corresponding water-soluble metal salts in the presence of protective colloids such as gelatin, polyvinyl alcohol, carboxymethyl cellulose, gum arabic and colloidal silica, or dispersions of the sulfides can be produced by reacting the solutions of the corresponding metal salts with water-soluble sulfides. Suitable methods of producing a dispersion of nuclei can be selected from those described in *Gmelins Handbuch der anorganishen Chemie*, Verlag Chemie (Weinheim). The precipitating nuclei can be incorporated into the image-receiving layer using various techniques. One method is to disperse these nuclei in hydrophilic polymers such as gelatin, polyvinyl alcohol, polyacrylamide, hydroxymethyl cellulose, and the like; another method is to vapor-deposit these nuclei onto a polymeric member, as described in U.S. Pat. Nos. 3,234,022 and 3,295,972; and another method is to incorporate these nuclei into the cellulose produced by hydrolyzing cellulose acetate.

To improve the hue of the silver image formed on the silver precipitating nuclei, it is preferred to introduce arylmercapto compounds or heterocyclic mercapto compounds into the image-receiving layer. Representative examples of tone controlling agents which can be used in the present invention are described in G. F. Van Veelan et al., *Photographische Korrespondenz*, Vol. 99, pages 139 to 134 (1963), British Patent No. 969,996, U.S. Pat. No. 3,433,640, and German Patent No. 1,942,884, etc.

The developer contained in the film unit of the present invention comprises a strong developer for silver halide and dissolved silver salt (silver complex salt) or a precursor which provides the strong developer as a result of hydrolysis. The developer can be placed at various positions in the unit such as in the processing solution, the emulsion layer, or the image-receiving layer, etc. Preferred developers are hydroquinone alkylhydroquinones such as t-butylhydroquinone; arylhydroquinones such as phenylhydroquinone; alkoxyhydroquinones such as ethoxyhydroquinone; hydroquinone derivatives as described in U.S. Pat. Nos. 2,939,788, 3,002,997, 3,003,876, 3,019,108, and 3,065,075; N-substituted aminophenols such as N-methyl-p-aminophenol, N,N-dimethyl-p-aminophenol, and those compounds as described in U.S. Pat. No. 3,091,530; catechols; and benzenoid developers such as p-phenylenediamines. Moreover, reducing agents having an open chain structure such as hydroxylamine, N-dimethoxyethylhydroxylamine, N,N-diethylhydroxylamine, the hydroxylamines as described in U.S. Pat. No. 3,293,034, ascorbic acid, reductone, aminoreductone, and the like can be used. 1-Phenyl-3-pyrazolidinone or substituted derivatives thereof can be used simultaneously.

The film unit of the present invention preferably contains a silver complex salt-forming agent to dissolve the silver halide in the alkaline solution as a stable complex salt. Particularly, it is preferred that the complex salt-forming agent is contained in the processing composition. As the silver complex salt-forming agent, inorganic compounds such as thiosulfates, e.g., sodium thiosulfate, potassium thiosulfate, ammonium thiosulfate, and the like, thiocyanates, e.g., sodium thiocyanate, potassium thiocyanate, ammonium thiocyanate, and the like; cyclic imide compounds as described in U.S. Pat. Nos. 2,857,274, 2,857,275, and 2,857,276 such as uracil, barbituric acid, hydantoin and the like; amines, such as ethylamine, ethanolamine and the like, as described in U.S. Pat. No. 3,343,958 and combinations thereof with cystine; and active methylene compounds such as the bissulfonylmethanes as described in Japanese Patent Laid-open No. 43937/1973, etc. can be used.

It is preferred that the processing composition as used in the present invention be contained in a rupturable container. Preferably, the rupturable container is produced by folding a sheet of a liquid or air impermeable material and sealing each of the edges, with the container retaining the processing composition in the space thereof, and is ruptured at a predetermined position due to the inner pressure applied to the processing composition when the container is passed through the pressure applying member, thereby liberating the contents thereof. Preferred materials which can be used in producing the container are polyethylene terephthalate/polyvinyl alcohol/polyethylene laminate and lead foil/vinylchloride vinyl acetate copolymer laminate, etc. It is preferred that the container be fixed along the leading edge of the film unit so that the contents of the container can be spread over the surface of the photosensitive element substantially in one direction. Preferred containers which can be used in the present invention are described in U.S. Pat. Nos. 2,543,181, 2,643,886, 2,653,732, 2,723,051, 3,056,491, 3,056,492, 3,153,515, and 3,173,580.

Supports which can be used in the present invention are planar members which are not substantially dimensionally changed by the processing solution during the period of processing. Depending upon the purpose, a rigid support such as glass can be used and, in general, flexible supports are useful. As the flexible support, those members generally used in photographic materials, such as cellulose nitrate film, cellulose acetate film, polyvinyl acetate film, polystyrene film, polyethylene terephthalate film, and polycarbonate film, etc. are preferably used. Dimensionally stable and oxygen impermeable supports, such as a laminate comprising a polyvinyl alcohol layer interposed between polyethylene terephthalate layers or cellulose acetate layers, are most preferred in that the image stability is excellent and little stain occurs. To facilitate evaporation of the water contained in the processing solution through the support after the processing, it is preferred to use a vapor permeable support as described in U.S. Pat. No. 3,573,044.

To prevent light deterioration of the silver halide emulsion layer from the edge of the transparent support at the stage of processing the film unit in a bright place, the transparent support is preferably colored to the extent that the transmission of light is prevented without hindering the imagewise exposure and observation. The support can contain, if desired, plasticizers such as phosphoric acid esters and phthalic acid esters, ultraviolet light absorbers such as 2-(2-hydroxy-4-butylphenyl)-benzotriazole, and antioxidants such as hindered phenols. To maintain the adhesion between the support and the hydrophilic polymer containing layer, it is preferred that an undercoating layer be provided or that the surface of the support be subjected to a pretreatment such as corona discharge, ultraviolet light radiation, or flame treatment, etc. The thickness of the support generally ranges from about 20 to about 300 microns.

The diffusion transfer photographic film unit of the present invention preferably has the capability of neutralizing the alkali brought in the processing composition. The processing composition contains an alkali to provide a high pH of not less than about 10, preferably not less than 11, which is sufficient to promote the development of the silver halide emulsion and the formation of the image due to the reduction of the diffusible silver complex salt. After the formation of the diffusion transfer image is substantially completed, the pH of the film unit is reduced to the vicinity of neutrality, e.g., not more than about 9 and preferably not more than 8, so that additional image formation is materially stopped, the variation with time in the image tone is prevented, and the discoloration and fading of the image, and the deterioration of the white background, which are all caused by high pH, are minimized. For this purpose, it is preferred, as described in U.S. Pat. No. 3,362,819 and 3,362,821, to incorporate into the film unit a neutralizing layer containing an acid material in an amount sufficient to neutralize the alkali contained in the processing solution to the above pH, i.e., a neutralizing layer containing an acid material which has an area density more than equivalent to the alkali of the spread processing solution. Preferred acidic materials are compounds having an acidic group, the pKa of which is not more than about 9, particularly a carboxyl group or a precursor group which provides such an acidic group when hydrolyzed. As more preferred acidic materials, higher aliphatic acids such as oleic acid as described in U.S. Pat. No. 2,983,606 and polymers of acrylic acid, methacrylic acid and maleic acid, and half-esters or acid anhydrides thereof as described in U.S. Pat. No. 3,362,819 can be used. Representative examples of polymeric acidic materials are copolymers of vinyl monomers such as ethylene, vinyl acetate, vinyl methyl ether, and the like, and maleic anhydride, and the n-butyl half esters thereof; copolymers of butylacrylate and acrylic acid; and cellulose acetate hydrogen phthalate, etc.

In addition to these acidic materials, the neutralizing layer can contain polymers such as cellulose nitrate and polyvinyl acetate, and the plasticizers as described in U.S. Pat. No. 3,557,237. Moreover, the neutralizing layer can be cross-linked by the use of polyfunctional aziridene compounds, epoxy compounds, or the like. The neutralizing layer is incorporated into the image-receiving element and/or the photosensitive element. Particularly, it is preferred that the neutralizing layer placed between the support and the image-receiving layer of the image-receiving element. The acidic materials as described in U.S. Pat. No. 3,576,625 can be micro-encapsulated and introduced into the film unit.

It is preferred that the neutralizing layer and the acidic material-containing layer be separated from the processing solution layer to be spread by a neutralization rate controlling layer. This neutralization rate controlling layer prevents the unwanted reduction of the density of the transferred image due to an early reduction of the pH caused by the neutralizing layer before the development of the silver halide emulsion layer and the formation of the diffusion transfer image are completed, and retards the reduction of the pH until after the development and transfer are completed.

In a preferred embodiment of the present invention, the image-receiving member is a multi-layer construction comprising, in sequence, a support—neutralizing layer—neutralization rate controlling layer—image-receiving layer. The neutralization rate controlling layer is mainly composed of polymers such as gelatin, polyvinyl alcohol, polyvinyl propylether, polyacrylamide, hydroxypropylmethyl cellulose, isopropyl cellulose, partial polyvinyl butyral, partially hydrolyzed polyvinyl acetate, and copolymers of $\beta$-hydroxyethyl methacrylate and ethyl acrylate, etc. These polymers are preferably cured by cross-linking using aldehyde compounds such as formaldehyde or N-methylol compounds or like compounds. A preferred thickness of the neutralization rate controlling layer ranges from about 2 to about 20 microns.

In the present invention, light-reflecting materials are used to form a white background of the silver image formed on the image-receiving layer. Suitable light-reflecting materials are titanium dioxide, barium sulfate, zinc oxide, alumina, barium stearate, calcium carbonate, silicon dioxide, zirconium oxide, kaolin, and magnesium oxide, etc. These materials can be used alone or in admixture with each other. These light-reflecting materials can be previously prepared or can be produced at a predetermined positon from precursors thereof placed in the film unit, as described in U.S. Pat. Nos. 3,615,421 and 3,620,724. These light-reflecting materials can be either contained in a layer which contains as a binder hydrophilic polymers such as polyvinyl alcohol, gelatin, hydroxypropyl cellulose, and polyvinyl pyrrolidone, or contained in the processing composition so that the material is dispersed and fixed in a layer of a film-forming polymer such as hydroxyethyl cellulose or carboxyethyl cellulose which is formed by spreading the processing solution.

When fluorescent brightening agents such as stilbene, cumarone, triazine or oxazole are used in combination with these light-reflecting materials, a good white background can be obtained.

To protect the silver halide emulsion from the surrounding light during processing, it is preferred to add, as described in U.S. Pat. No. 3,647,437, dyes which are colored at a pH above the pKa of the dye and becomes colorless at a pH below the pKa of the dye, together with the light-reflecting material. The light-reflecting material-containing layer is composed of the light-reflecting material and a polymer binder in the weight ratio of the light-reflecting material to the polymer binder of about 0.5:1 to 100:1. The layer preferably has a dry thickness of about 5 to 50 microns and possesses a light reflection factor of more than 50% and preferably more than 70%.

The film unit of the present invention has a rupturable container which retains the processing composition. This container when pressed by a pressure applying member is ruptured due to the inner pressure, liberating the contents in a predetermined manner. As the pressure applying member, various kinds of members can be used, and a pressure applying member comprising at least one pair of members which are juxtaposed with a definite clearance therebetween is particularly suitable. The pair of members are fixed with a definite clearance and push each other under a definite pressure by an elastic means such as a spring. These members can be rods, freely rotating rollers, or motor driven rollers. When the film unit passes between the juxtaposed pressure applying members, the container is ruptured, thereby liberating and spreading the processing composition between the two elements in the form of a layer. As the juxtaposed pressure applying members, those members as described in U.S. Pat. Nos. 3,647,441 and 3,652,281 can be advantageously used.

Referring now to the drawings in greater detail, FIG. 1 shows an embodiment wherein the film unit of the present invention is exposed in a camera. A photosensitive sheet 1 lying on a pressure plate 101 is imagewise exposed to light passed through a camera lens 100. At this time, a composite structure 6 comprising an image-receiving element and a light-shielding element is positioned below the pressure plate in such a manner that the image-receiving element 2 is faced toward the lens 100. A leader paper 5 is connected to one end of the photosensitive element 1, introduced into an opening 8 making a circuit of the pressure plate 101, passed through the composite structure 6, and withdrawn from one end of the composite structure 6. The composite structure 6 is edged with a binding member 7. The rear end of the photosensitive element 1 is provided with an excess liquid reservoir 9. When the photosensitive element 1 is introduced into the composite structure 6, this rear end serves as a stopper to determine their relative positions. The leader paper 5 is pulled while maintaining the composite structure 6 stationary and thus the photosensitive element 1 is fixed in the composite structure 6 for processing. Then, the film unit is drawn through a pair of rollers 102 and thus the processing solution container is ruptured, thereby liberating the contents thereof.

FIG. 2 shows the surface of the processed film unit. A positive image is obtained.

FIG. 3 shows the back of the processed film unit. A ruptured processing solution container 4' is present at the front part of the film unit and the leader paper 5 is appropriately cut off.

FIG. 4 shows another embodiment wherein the film unit of the present invention is exposed in a camera. This embodiment is substantially the same as FIG. 1 except that a sheet conveying means 103 is used in place of the leader paper 5 and the photosensitive element 1 is introduced into the composite structure 6 by means of the sheet conveying means 103.

FIG. 5 shows the back of the composite structure 6 of the film unit, showing the opening 8 for introducing the photo sensitive element. After exposure, the photosensitive element 1 is conveyed in the U-form by means of the sheet conveying means 103 and finally, introduced through a slit 104 and the opening 8 into the composite structure 6. The thus united film unit is passed through a pair of rollers 102 for applying pressure and thus the processing solution is spread.

FIG. 6 shows the surface of the processed film unit. A positive image is obtained.

FIG. 7 shows the back of the processed film unit. The opening part is covered with an extended part of the light-shielding element 3 and the ruptured processing solution container 4' remains at the front end.

FIG. 8 shows a sectional view of the film unit of FIG. 2 along the direction that the film unit proceeds to the pressure applying member, in which 61 is the light sensitive member of the light sensitive element, 51 is the transparent support of the light sensitive element, 60 is a light-shielding layer, 70 is the transparent support of the image-receiving element and 74 is the image-receiving layer of the image-receiving element.

FIG. 9 shows a sectional view of the composite structure 6 taken along the direction in which the film unit proceeds. A folded covering member 83 is attached to the end of the light-shielding element 3. The covering member acts to seal the opening portion when the film unit passes through the pressure applying member.

FIGS. 10 and 11 show sectional views of the processed film unit which are taken along a plane perpendicular to the direction in which the film unit proceeds. A combining member 7 placed outside of the element and a combining element 11 placed between the two elements provide the processing solution layer spread 10 with a definite layer thickness. In the film unit which is combined in the manner as shown in FIG. 11, the light-shielding element and the photosensitive element can be easily peeled off from the back. This construction is useful in reusing the processed photosensitive element as a negative for printing.

The invention is explained in greater detail by reference to the following examples. Unless otherwise indicated, all parts, percents, ratios and the like are by weight.

EXAMPLE 1

A 5 $\mu$ thick gelatin layer containing a dispersion of stearic acid amide and 2-(2-hydroxy-4-tert-butylphenyl)benzotriazole was coated on a 80 $\mu$ thick polyethylene terephthalate film as a back layer. Then, the following four layers were successively coated on the opposite side of the polyethylene terephthalate film.

1. Polymer Acid Layer

A 20 $\mu$ thick layer of the n-butyl half ester of a copolymer of vinyl methyl ether and maleic anhydride (Gantrez AN, trade name, produced by GAF Co., specific viscosity in methyl ethyl ketone: about 1.2) which was cross-linked with 1,4-bis(2',3'-epoxypropoxy)butane.

2. Neutralization Rate Controlling Layer

A 5 $\mu$ thick layer of a 1:3 (molar ratio) copolymer of n-butyl-acrylate and $\beta$-hydroxyethyl methacrylate (molecular weight about 50,000).

3. Silver Halide Emulsion Layer

A silver halide emulsion layer produced by coating a silver iodide bromide emulsion which was panchromatically sensitized with the following optical sensitizers wherein the iodide content was 4.5 mole % and the average grain size was 1.1 microns, in such a manner that the amounts of silver and gelatin were 25 g/m² and 58 g/m², respectively.

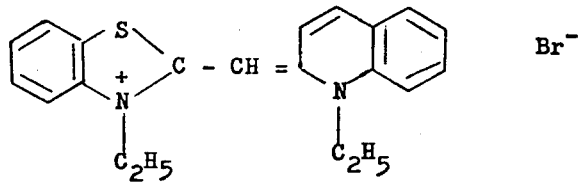

-continued

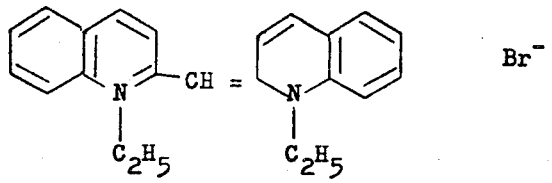

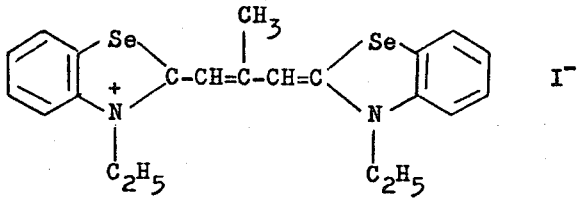

4. Light-Shielding Layer (the uppermost layer)

A mixture of 600 ml of water, 7.5 g of sodium bis(2-ethylhexyl)-α-sulfosuccinate, and 2.4 g of sodium hydroxide was admixed with 300 g of furnace type carbon black and after being allowed to stand for 24 hours, the resulting mixture was dispersed using a colloid mill. The dispersion so prepared was gradually added with stirring to 3750 g of an aqueous gelatin solution at 40°C which contained 750 g of gelatin. The resulting mixture was kneaded with a kneader at 40°C for 3 hours. The carbon black dispersion was coated in a thickness of 4.5 microns.

The gelatin layers of (3) and (4) were hardened with mucochloric acid. Thus, a photosensitive element was produced.

Next, an image-receiving element was prepared in the following manner.

A 120 μ thick cellulose triacetate film which was plasticized with triphenylphosphate and had a 7 μ thick gelatin layer as a back layer, was dipped in a hydrolyzing bath (liquid temperature of 35°C) containing the following ingredients for 40 seconds, washed with flowing water for 4 minutes, and finally dried.

| Ingredients | |
|---|---|
| Glycerin | 150 g |
| Nickel Nitrate (hexahydrate) | 17 mg |
| Sodium Sulfide (nonahydrate) | 3.1 g |
| Sodium Hydroxide | 120 g |
| Methyl Alcohol | 720 ml |
| Water | 480 ml |

1.2 ml of a processing solution having the following composition and a viscosity of about 30,000 was charged to a container which was produced by folding a lead foil provided with a lining of a copolymer of vinyl chloride and vinyl acetate, and then heat-sealed. The preparation of the processing solution and the charge of the processing solution to the container were carried out under a nitrogen atmosphere.

| Processing Solution | |
|---|---|
| N,N-bis(hydroxyethyl)hydroxylamine | 1.6 g |
| Zinc Chloride | 0.1 g |
| Uracil | 1.2 g |
| Hydroxyethyl Cellulose (High viscous product) | 0.72 g |
| Potassium Hydroxide | 3.5 g |
| Ethylenethiourea | 1.3 mg |
| Titanium Dioxide | 7.0 g |
| Water | 15 ml |

By the use of the image-receiving element, the processing solution container and a light-shielding element of a 165 μ thick cellulose triacetate containing 2.5% by weight of carbon black, an envelope-like sheet assembly as shown in FIG. 8 was produced. In this case, a laminate film comprising polyethylene terephthalate layers containing titanium dioxide and an aluminum vapor-deposited film interposed between them was used as the combining member. The inside of the laminate film was provided with a polyvinyl acetate layer so as to enable heat-sealing. A leader paper was connected to one end of the thus prepared photosensitive sheet and extended through the envelope-like sheet assembly. Thus, a film unit was produced.

The picture size was a square of 80 mm × 80 mm and the film unit was assembled in such a manner that the processing solution was spread in a thickness of 100 microns.

This composite structure was placed in a camera in the manner as shown in FIG. 1. An outdoor scene was photographed at a lens opening of $f$=16 and at a shutter speed of 1/500 the second After each exposure was completed, the leader paper was pulled and the exposed film was drawn through the pressure applying rollers. This procedure was carried out outside but in the shade.

One minute after the film unit was withdrawn from the camera, a black and white image was obtained. On measuring the reflection density, the maximum density was 1.5 and the minimum density was 0.2.

After photographing the same object, the camera was brought into a darkroom and the film unit was processed therein. On measuring the density, the maximum density was 1.6 and the minimum density was 0.2, and thus substantially the same results were obtained.

EXAMPLE 2

The following layers were successively coated on a 125 μ thick cellulose triacetate film containing triphenyl phosphate as a plasticizer to produce a photosensitive element.

1. Silver Halide Emulsion Layer

A silver halide emulsion layer was produced by coating a silver iodide bromide emulsion which was panchromatically sensitized with the following optical sensitizers wherein the iodide content was 3.0 mole % and the average grain size was 1.0 micron, in such a manner that the amounts of silver and gelatin were 25 g/m² and 58 g/m², respectively and by hardening with 3-hydroxy-5-chloro-S-triazinalated gelatin as described in U.S. Pat. No. 3,362,827.

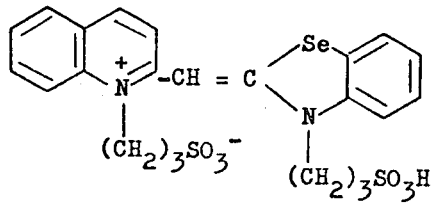

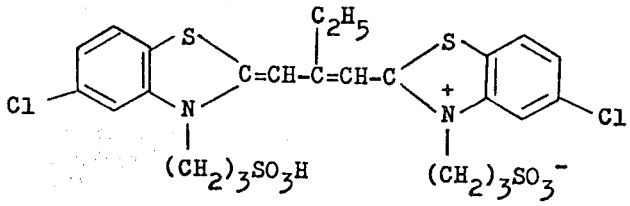

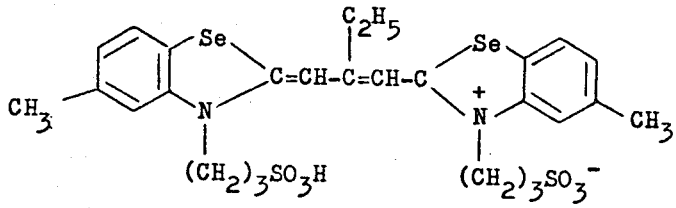

2. Intermediate Layer

A gelatin layer of 6.5 g/m² which was not hardened.

3. Light-Shielding Layer

A mixture of 50 g of furnace type carbon black, 1.5 g of sodium myristylsulfate, 0.5 g of sodium hydroxide, and 150 ml of water was kneaded with a colloid mill to prepare a paste. 500 g of a 10% gelatin aqueous solution was added to the paste and then a 5% citric acid solution was added with stirring to adjust the pH of 5.5. The thus prepared solution was coated in a thickness of 3.2 microns. No hardening agent was added.

The following layers were successively coated on a 125 μ thick cellulose triacetate film base containing triphenylphosphate as a plasticizer to prepare an image-receiving element.

1. Undercoating Layer

A 1 μ thick polyvinyl alcohol layer, which prevented organic solvents, i.e., methyl ethyl ketone and ethyl acetate, from dimensionally changing the film base in coating a neutralizing layer.

2. Neutralizing Layer

A 20 μ thick layer of the n-butyl half ester of a (1:1 molar ratio) copolymer of vinyl acetate and maleic anhydride (molecular weight about 40,000) which was hardened with triethylenephosphoramide.

3. Neutralization Rate Controlling Layer

A 5.5 μ thick layer of polyvinyl butyral (molecular weight about 20,000).

4. Image-Receiving Layer

A layer containing a silver precipitating layer of gold in polyvinyl alcohol wherein the amounts of polyvinyl alcohol and gold nuclei were 55 g/m² and 20 mg/m², respectively. These gold nuclei were pinkish and were produced by reducing tetrachlorogold(III)sodium with sodium borohydride at a pH of 9 to 10. This layer contained a small amount of 1-phenyl-5-mercaptotetrazole as a silver image color controlling agent.

1.2 ml of a processing solution having the following composition was placed on a container which was produced by folding lead foil provided with a lining of a copolymer of vinyl chloride and vinyl acetate as described in U.S. Pat. No. 2,634,886 and stored therein by heat-sealing the edges. The preparation of the processing solution and the charging of the processing solution into the container were carried out under a nitrogen atmosphere.

| Processing Solution | |
|---|---|
| Water | 100 ml |
| Sodium Sulfite (anhydrous) | 5.0 g |
| Sodium Thiosulfate | 6.5 g |
| Sodium Hydroxide | 6.0 g |
| Diethylhydroxylamine | 7.8 g |
| 4-Amino-2,6-diethylphenol Hydrogen Chloride | 3.0 g |
| Sodium Carboxymethyl Cellulose | 4.5 g |
| Titanium Dioxide | 45 g |

Using the thus-prepared image-receiving element and processing solution container, and a shielding element of a 165 μ thick cellulose triacetate film containing 2.5% by weight of carbon black, an envelope-like structure as shown in FIGS. 5 and 9 was produced. As the combining member 7, a laminate member comprising two polyethylene terephthalate layers containing titanium dioxide and an aluminum deposited film layer interposed between them, and furthermore, having a heat-sealing layer of polyvinyl acetate on one side, was used. The picture size was a square of 80 mm × 80 mm and the film unit was designed to allow the processing solution to be spread in a thickness of 85 microns.

The photosensitive element 1 and the combining member 7 were incorporated into the camera having the function as shown in FIG. 7 and a standard photographic chart was photographed at a lens opening of $f$=16 and at a shutter speed of one five-hundreth of a second. The photosensitive element was imagewise exposed through the transparent support, conveyed in a U-form by a roller driven by a motor of the sheet conveying apparatus 103, and introduced through a delivery slit 104 into the composite structure with the image-receiving layer facing the lens. The thus united film unit was withdrawn from the camera through the pressure applying rollers driven by a motor to the outside of the camera. Then, the processing was started, and a black and white image was produced. These procedures were carried out outside in the shade. On measuring the density, the maximum density was 1.7 and the minimum density was 0.15. They were substantially the same as the values of 1.7 and 0.2, respectively, which were obtained by carrying all the procedures after processing in a darkroom.

On measuring the weight of the film unit which was placed after the processing in a room under the conditions of a temperature of 25°C and 60% relative humidity, it was found that the water brought by the processing solution could be removed from the film unit in about 5 days.

At 20 days after the processing, the negative film was peeled off from the film unit and subjected to the following treatment. Then, a negative was obtained which could be used as an original image for printing of a conventional printing paper.

| Additional Treatment | |
|---|---|
| (1) Fixation | 25°C, 5 minutes |
| (2) Washing | 16°C, 10 minutes |
| (3) Removal of the Light-Shielding Layer | Non-hardening Kodak F-24 (Photo Lab Index, HM Lester, editor, Morgan & Morgan (1957) ) was used as a fixing solution to dissolve and remove the unhardened layer by applying a jet of hot water at 45°C to the layer. |

While the invention has been described in detail and with reference to specific embodiments thereof, it will be apparent to one skilled in the art that various changes and modifications can be made therein without departing from the spirit and scope thereof.

What is claimed is:

1. A silver salt diffusion transfer photographic film unit comprising:

1. a photosensitive element comprising a transparent support having a silver halide emulsion layer thereon,
2. an image-receiving element comprising a transparent support having an image-receiving layer containing silver precipitating nuclei thereon,
3. a light-shielding element which has substantially the same area as the image-receiving element and which protects the silver halide emulsion layer of the photosensitive element from ambient light during the development of the film unit in a bright place,
4. a rupturable container retaining an alkaline processing solution and positioned to allow the alkaline processing solution to spread in the form of a layer into a clearance between the emulsion layer of the photosensitive element and the image-receiving layer of the image-receiving element,
5. a light-reflecting material in an amount sufficient to form a white background of a transferred silver image which is positioned between the image-receiving layer of the image-receiving element and the emulsion layer of the photosensitive element, said light-reflecting material being located in a layer coated on the image-receiving layer, in the alkaline processing solution, or in combinations of these locations, and
6. a silver halide developer;

wherein the image-receiving element and the light-shielding element are juxtaposed in such a manner that the image-receiving layer of the image-receiving element faces inside, and are fixed at at least one edge thereof to form a composite structure having an opening through which the photosensitive element after exposure can be introduced between the image-receiving element and the light-shielding element in such a manner that the emulsion layer of the photosensitive element faces the image-receiving layer of the image-receiving element; and means for placing said photosensitive element into said composite structure after exposure; said film unit further including a complex forming agent for dissolving silver halide.

2. The film unit according to claim 1, which further contains a neutralizing layer containing an acid in an amount sufficient to substantially neutralize the spread alkaline processing solution; said neutralizing layer being located between said transparent support of said photosensitive element and said emulsion layer, or between said transparent support of said image-receiving element and said image-receiving layer, or at both of these positions.

3. The film unit according to claim 1, which further contains a neutralizing layer containing an acid in an amount sufficient to neutralize the alkaline processing solution to a pH where silver halide development is materially stopped after the formation of the transferred silver image is materially completed; said neutralizing layer being located between said transparent support of said photosensitive element and said emulsion layer, or between said transparent support of said image-receiving element and said image-receiving layer, or at both of these positions.

4. The film unit according to claim 2, wherein the neutralizing layer contains an acid in an amount in excess of the equivalent of the amount per area of the alkali contained in the spread processing solution.

5. The film unit according to claim 2, wherein the neutralizing layer contains a polymer having a free carboxyl group or a free sulfo group.

6. The film unit according to claim 1, wherein the surface of the emulsion layer is coated with a processing solution-permeable light-shielding layer which contains a light-absorbing material in an amount sufficient to protect the emulsion layer from ambient light during the time when the film unit is developed in a bright place outside of a camera.

7. The film unit according to claim 6, wherein the light-shielding layer is further coated with a processing solution-permeable layer containing at least a portion of the required amount of the light-reflecting material.

8. The film unit according to claim 1, wherein at least a portion of the required amount of the light-reflecting material is contained in the processing solution.

9. The film unit according to claim 1, wherein the surface of the image-receiving layer is coated with a processing solution-permeable layer which contains at least a portion of the required amount of the light-reflecting material.

10. The film unit according to claim 1, wherein the surface of the silver halide emulsion layer is coated with a processing solution-permeable light-shielding layer which contains a light-absorbing material in an amount sufficient to protect the silver halide emulsion layer from ambient light during-the development in a bright place outside of a camera, and the processing solution contains a substantial portion of the amount of the light-reflecting material necessary to form a white background of the transferred silver image.

11. The film unit according to claim 1, wherein the surface of the silver halide emulsion layer is coated with a processing solution permeable light-shielding layer which contains a light-absorbing material in an amount sufficient to protect the silver halide emulsion layer from ambient light during development in a bright place outside of a camera, and the surface of the image-receiving layer is coated with a layer which contains a substantial portion of the amount of the light-reflecting material necessary to form the white background of the transferred silver image.

12. The film unit according to claim 1, wherein the surface of the image-receiving layer is coated, in sequence, with a processing solution permeable layer which contains a light-reflecting material in an amount sufficient to form a white background of the transferred silver image, and a processing solution-permeable light-shielding layer to protect the silver halide emulsion layer from ambient light during development in a bright place outside of a camera.

13. The film unit according to claim 1, wherein the processing solution contains a dye which is colored at a pH above the pKa of the dye and becomes colorless at a pH below the pKa of the dye in an amount sufficient to protect the silver halide emulsion layer from ambient light during development of the film unit in a bright place outside of a camera, as well as the light-reflecting material.

14. The film unit according to claim 1, wherein said means for placing said photosensitive element in the said composite structure is a leader sheet connected to one end of the photosensitive element which is passed through the opening of the combined member, and between the image-receiving element and the light-shielding element, and thus passed through the composite structure.

15. The film unit according to claim 1, wherein the processing solution container is fixed to one end of the image-receiving element of the combined member.

16. The film unit according to claim 15, wherein the combined member has an opening for introducing the photosensitive element at an end part on the side of the processing solution container.

17. The film unit according to claim 15, wherein the combined member has an opening for introducing the photosensitive element at an end part on the opposite side of the processing solution container.

18. The film unit according to claim 1, wherein the image-receiving element and the light-shielding element are combined at at least two opposite side edges to form a combined member.

19. The film unit according to claim 1, wherein the surfaces of the photosensitive element, the image-receiving element, and the light-shielding element coming into contact have been subjected to an antistatic treatment and/or lubricating treatment.

20. The film unit according to claim 1, wherein the image-receiving element contains a metal sulfide or colloidal particles of a heavy metal as the silver precipitating nuclei.

21. The film unit according to claim 20, wherein the metal sulfide of the silver precipitating nuclei is selected from the group consisting of silver sulfide, gold sulfide, copper sulfide, lead sulfide, nickel sulfide, cobalt sulfide, and cadmium sulfide.

22. The film unit according to claim 20, wherein the metal for the silver precipitating nuclei is selected from the group consisting of silver, gold, palladium, and platinum.

23. The film unit according to claim 1, wherein the image-receiving element contains silver precipitating nuclei in a hydrophilic colloid.

24. The film unit according to claim 1, wherein the image-receiving element contains silver precipitating nuclei in a regenerated cellulose.

25. The film unit according to claim 1, wherein the processing solution contains the silver halide developer.

26. The film unit according to claim 1, wherein the silver halide developer or a precursor thereof which provides the developer as a result of hydrolysis is contained in at least one of an emulsion layer of the photosensitive element and the image-receiving layer of the image receiving element.

27. The film unit according to claim 1, wherein the complex forming agent is contained in the processing solution.

28. The film unit according to claim 1, wherein the image-receiving layer contains heterocyclic mercapto compounds or arylmercapto compounds together with the silver precipitating nuclei.

* * * * *